United States Patent [19]

Nakaya

[11] 4,337,379

[45] Jun. 29, 1982

[54] PLANAR ELECTRODYNAMIC ELECTROACOUSTIC TRANSDUCER

[75] Inventor: Takao Nakaya, Hamamatsu, Japan

[73] Assignee: Nippon Gakki Seizo Kabushiki Kaisha, Hamamatsu, Japan

[21] Appl. No.: 109,111

[22] Filed: Jan. 2, 1980

[30] Foreign Application Priority Data

Jan. 16, 1979 [JP] Japan ..... 54-3639
Jan. 18, 1979 [JP] Japan ..... 54-4286[U]

[51] Int. Cl.[3] ..... H04R 9/00
[52] U.S. Cl. ..... 179/115.5 PV
[58] Field of Search ..... 179/115.5 PV

[56] References Cited

U.S. PATENT DOCUMENTS 3,873,784 3/1975 Doschek ..... 179/115.5 PV

FOREIGN PATENT DOCUMENTS 2020484 11/1971 Fed. Rep. of Germany ... 179/115.5 PV
1329295 4/1963 France ..... 179/115.5 PV
52-41520 3/1977 Japan ..... 179/115.5 PV
6613713 4/1968 Netherlands ..... 179/115.5 PV

*Primary Examiner*—George G. Stellar
*Attorney, Agent, or Firm*—Cushman, Darby & Cushman

[57] ABSTRACT

A planar type electroacoustic transducer comprising a diaphragm; at least one magnet plate on which are formed a plurality of mutually different and spaced magnetic poles in a matrix shape of columns and rows so as to face the diaphragm at a distance enough to involve the facing surface of the diaphragm within magnetic fields associated with the magnetic poles; and an electric conductor formed on the diaphragm to run in alternate directions of a column and a row along a path corresponding to the spaces defined between the respective magnetic poles without straightforwardly passing by any two magnetic poles of a same column or row. This diaphragm may be provided with ribs to further minimize the development of partial vibrations of the diaphragm. Those portions of the conductor running in regions of weak magnetic fields may have an enlarged size or smaller length to reduce the impedance of the conductor.

11 Claims, 21 Drawing Figures

PLANAR ELECTRODYNAMIC ELECTROACOUSTIC TRANSDUCER

BACKGROUND OF THE INVENTION (a) Field of the Invention

The present invention pertains to planar type electroacoustic transducers which are employed in headphones, loadspeakers, microphones or like devices.

(b) Description of the Prior Art

As electroacoustic transducers for converting electric signals to acoustic signals or for converting acoustic signals to electric signals, there have been developed various types of transducers including electrostatic type and electrodynamic type transducers. As electroacoustic transducers for use in, for example, headphones, there have been developed transducers of electrodynamic and planar types. As such example, FIG. 1 shows a diagrammatic partial plan view of a known planar type electroacoustic transducer arrangement. FIG. 2 is a sectional view taken along II—II in FIG. 1. In FIG. 1, there is provided, on a planar type diaphragm 1, a flexible electric conductor 2 in a wave-like pattern. A magnet plate 3 is arranged beneath the diaphragm 1 as shown in FIG. 2. This conductor 2 has straightly extending portions and curved portions which connect adjacent straightly extending portions to each other. The magnet plate 3 is provided with parallel rows of magnetic poles which are arranged to change in alternate fashion from one row to another. The straightly extending portions of the electric conductor 2 are arranged to be positioned between the respective rows of the magnetic poles so that each row having the same single pole extends along the straightly extending portions of the electric conductor 2. The magnetic fields which are produced at the straightly extending portions of the electric conductor 2 by these magnetic poles are indicated at symbols A, A, . . . in FIG. 2. Broken lines in FIG. 2 represent a part of the lines of magnetic flux.

The operation of the electroacoustic transducer shown in FIGS. 1 and 2 is as follows. If an electric current is caused to flow through the electric conductor 2 in the direction indicated by the arrow B shown in FIG. 1, a force acts on every portion of the conductor 2, excluding the curved portions thereof, in the direction indicated by the arrow E shown in FIG. 2 in accordance with Fleming's left-hand rule, so that the diaphragm 1 is lifted upwardly in FIG. 2. Conversely, if an electric current is caused to flow through the electric conductor 2 in a direction opposite to that shown by the arrow B in FIG. 1, the diaphram 1 is caused to descend downwardly in FIG. 2 toward the magnet plate 3. Thus, if a current carrying audio signal is caused to flow through the conductor 2, the diaphragm 1 will vibrate upwardly and downwardly in FIG. 2 in accordance with the current of the audio signals, so that the electric signals can be converted to acoustic signals.

However, in such known electroacoustic transducer as mentioned above, especially in conventional planar types of such devices, the electric conductor provided on a diaphragm is oriented to run merely in upgoing and downgoing directions on the diaphragm, and thus, there is the disadvantage that partial vibrations of the diaphragm tend to appear at sites between the adjacent runs of the conductor. Moreover, in such a conventional electroacoustic transducer, the diaphragm is simply flat in shape, and accordingly the diaphragm is poor in rigidity, and this also causes nodes of vibration mode to develop at portions of the diaphragm located between adjacent runs of the conductor, leading to development of partial vibrations.

SUMMARY OF THE INVENTION

It is, therefore, an object of the present invention to provide a planar type electroacoustic transducer which is free of those disadvantages of prior art devices and which minimizes the development of partial vibrations in a diaphragm.

Another object of the present invention is to provide such improved planar type electroacoustic transducer as described above, which is capable of accomplishing an effective use of magnetic fields of the magnet pieces which constitute the transducer.

A further object of the present invention is to provide a planar type electroacoustic transducer as described above, which is capable of providing quality sounds due to the abovementioned features.

Yet another object of the present invention is to provide a planar type electroacoustic transducer as described above, which is capable of improving the conversion efficiency between electric signals and acoustic signals.

Still further object of the present invention is to provide a planar type electroacoustic transducer as described above, which permits the employment of magnets of desired various configurations.

BRIEF DESCRIPTION OF THE DRAWINGS

Throughout the drawings, like parts are indicated by like reference numerals and symbols.

DETAILED DESCRIPTION OF THE PREFERRED EMBODIMENTS

Figure 1:
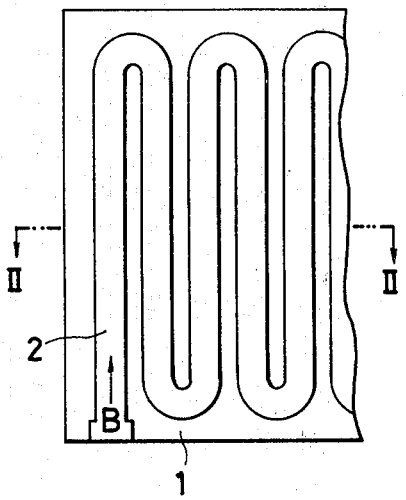
FIG. 1 PRIOR ART
FIG. 1 is a diagrammatic partial plan view of an example of conventional planar type electroacoustic transducer.
Figure 2:
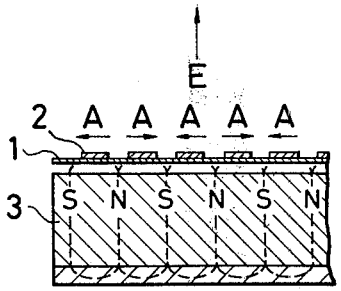
FIG. 2 PRIOR ART
FIG. 2 is a diagrammatic sectional view taken along the line II—II in FIG. 1.

As stated above, it is the primary object of the present invention to provide an improved planar type electroacoustic transducer which minimizes the development of partial vibrations in the diaphragm which tend to appear in conventional planar type transducers.

In accordance with an aspect of the present invention, magnet pieces are arranged in a matrix form of columns and rows, leaving intervals or spaces between any adjacent magnet pieces in the columns and rows, in such manner that the magnetic poles at their surfaces differ from adjacent ones in the respective columns and rows, and an electric conductor is arranged to run on a diaphragm along the spaces difined between the magnet pieces of the matrix of columns and rows in such manner that the electromagnetic forces which are generated on this conductor when an electric current is caused to flow through this conductor are oriented in a certain single direction.

An embodiment of the present invention will hereunder be described by referring to the drawings.

Figure 3:
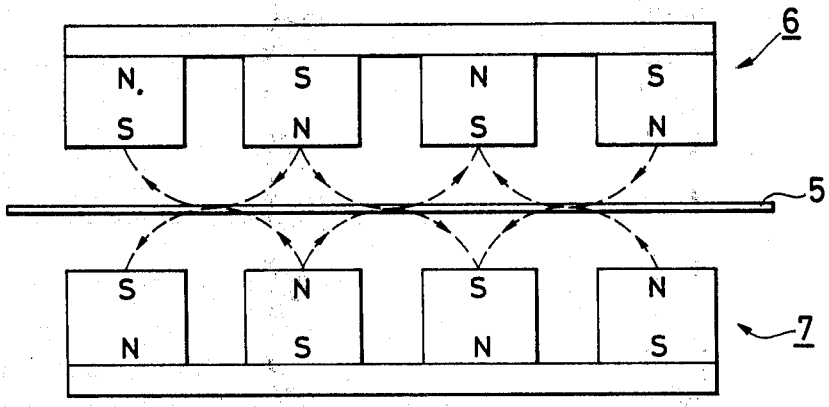
FIG. 3 is an explanatory diagrammatic side elevation of an embodiment of the planar type electroacoustic transducer, showing the basic principle of the present invention.
Figure 4:
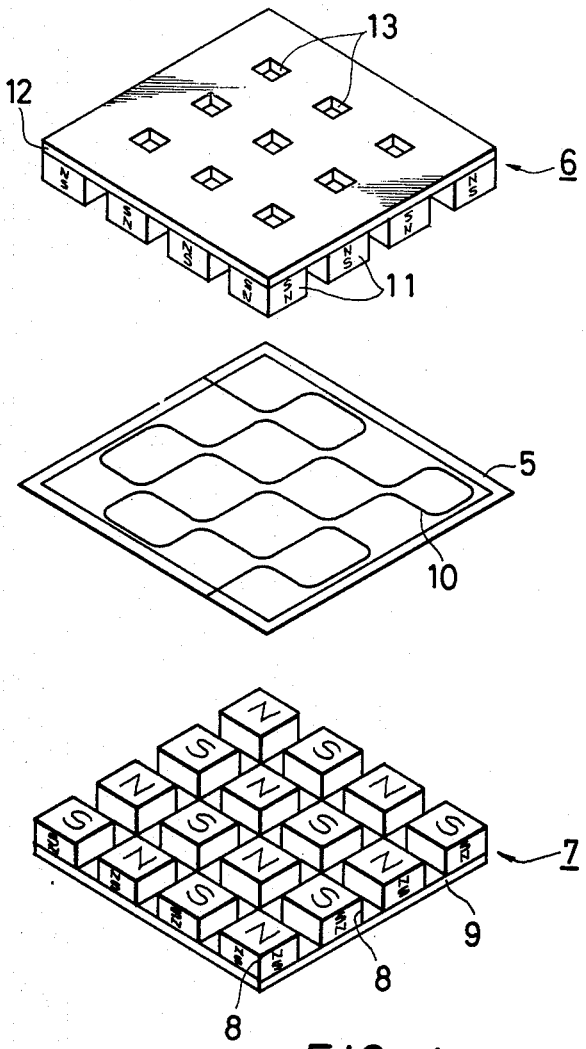
FIG. 4 is an explanatory diagrammatic exploded perspective view of the planar type electroacoustic transducer shown in FIG. 3, also showing the basic principle of the present invention.

FIG. 3 is an explanatory diagrammatic side elevation of an embodiment of the planar type electroacoustic transducer of the present invention, showing the basic principle of this invention. FIG 4 is a diagrammatic exploded view of the embodiment shown in FIG. 3.

The planar type electroacoustic transducer shown in this basic embodiment is of the arrangement comprising an electric-conductor-carrying diaphragm 5, an upper magnet plate generally indicated at 6 having a plurality of spaced magnet pieces, and a lower magnet plate generally indicated at 7 having positionally corresponding plurality of spaced magnet pieces, said upper and lower magnet plates 6 and 7 being provided to sandwich the diaphragm 5, leaving equal distances between the respective free surfaces of the magnet pieces and their corresponding surfaces of the diaphragm 5, so that the free surfaces of these magnet pieces on the respective opposingly arranged upper and lower magnet plates 6 and 7 face each other. In FIG. 3, the broken lines containing arrows represent part of the magnetic flux of the respective magnet pieces. As shown in FIG. 4, the lower magnet plate 7 is comprised of 16 magnet pieces 8, in this embodiment, which are arranged in a matrix form of columns and rows provided at right angles relative to each other on a yoke plate 9 which is made with a ferromagnetic material in such manner that these magnet pieces are disposed at equal intervals relative to each other leaving spaces therebetween. These magnet pieces 8, 8, . . . are magnetized in a direction perpendicular to the surface of the yoke plate 9, and they are arranged so that the magnetic poles at the respective surfaces of these magnet pieces are different from adjacent ones in all the columns and rows. Also, the yoke plate 9 is provided with a plurality of acoustic signal passage apertures 13, 13, . . . for discharging, to the outside of the magnet plate 7, acoustic signals produced by vibrations of the diaphragm 5, in a same manner and in positional coincidence with those acoustic signal passage apertures 13, 13, . . . of the upper magnet plate 6 which will be described later. That is, the upper magnet plate 6 is formed in exactly the same manner as that of the lower magnet board 7, and has 16 magnet pieces 11, 11, . . . which are carried on a yoke plate 12 provided with acoustic signal passage apertures 13, 13, . . . corresponding in number and arrangement as those of the lower magnet plate 7.

The magnet pieces 8, 8, . . . of the lower magnet plate 7 and those magnet pieces 11, 11, . . . of the upper magnet plate 6 are made of magnets of either the ferrite group or $RCo_5$ group. The symbol R in said $RCo_5$ group magnets represents a rare earth element such as Sm (Samarium) and Ce (Cerium). More particularly, $RCo_5$ group magnets include, for example, Samarium Cobalt $SmCo_5$, Cerium Cobalt $CeCo_5$, Copper-Substitution Samarium Cobalt $Sm(Co, Cu, Fe)_5$, and Copper-Substitution Cerium Cobalt $Ce(Co, Cu, Fe)_5$.

The diaphragm 5 which is employed in the present invention is made with a film of a high molecular material such as polyethylene terephthalate (P.E.T.), polyimide and polyethylene, and carries on one surface thereof an electric conductor 10 which is made with an electroconductive metal such as aluminum and copper. This electric conductor 10 is arranged on the diaphragm 5 so as to run in alternate directions of rows and columns of the matrix along the paths positionally corresponding to the spaces defined between the respective magnet pieces 8, 8, . . . of columns and rows of the lower magnet plate 7, in such manner that the electromagnetic forces which are developed by the magnetic fields which, in turn, are formed by the magnet pieces 8, 8, . . . , if an electric current is caused to flow through the conductor 10, are oriented in a certain single direction at all portions of the conductor 10 which is subjected to these electromagnetic forces. It should be noted that the respective magnet pieces 11, 11, . . . of the upper magnet plate 6 are arranged so that the magnetic poles at the respective surfaces of these magnet pieces 11, 11, . . . are identical with the magnetic poles at their opposing respective surfaces of those magnet pieces 8, 8, . . . of the lower magnet plate 7, as shown in FIG. 3.

Next, the operation of the above-stated example having the foregoing arrangement will be described.

Figure 5:
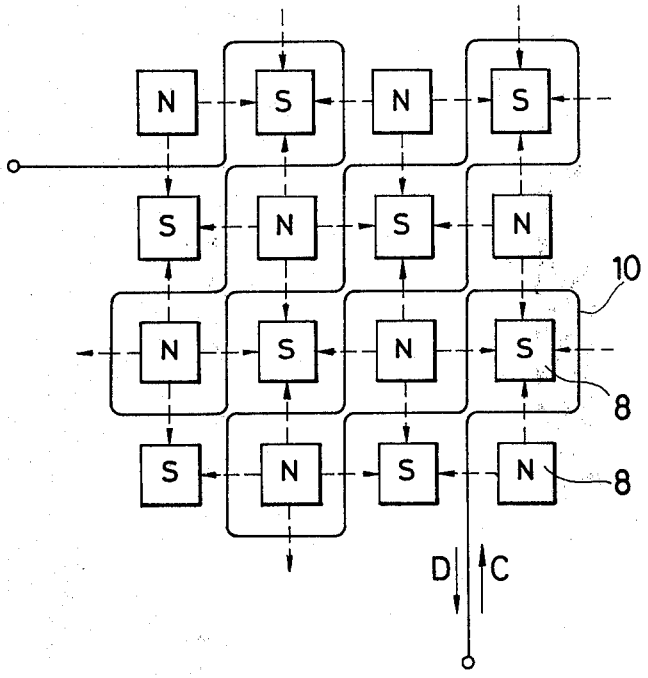
FIG. 5 is a diagrammatic illustration, showing the positional relationship between magnet pieces and an electric conductor which are employed in the planar type electroacoustic transducer shown in FIGS. 3 and 4.

FIG. 5 is an explanatory diagrammatic plan view showing the positional relationship between the magnet pieces 8, 8, . . . of the lower magnet plate 7, as an aid to explain the operation. It should be noted that the broken lines with arrows in FIG. 5 represent magnetic fields or magnetic flux, which are formed by the magnet pieces 8, 8, . . .

Let us now assume that an electric current is caused to flow through the electric conductor 10 in a direction indicated by the arrow C. The electric current flows through the conductor 10 which is located within the magnetic fields formed by the magnet pieces 8, 8, . . .

Accordingly, in accordance with Fleming's left-hand rule, the respective portions of the conductor 10 are subjected to electromagnetic forces of a same phase running in the direction leading from the rear side of the sheet of drawing toward the front side of this drawing. Conversely, if an electric current is caused to flow through the conductor 10 in a direction indicated by the arrow D in FIG. 5, the respective portions of the conductor 10 will be subjected to electromagnetic forces of an equal phase running from the front side of the sheet of drawing toward the rear side of this drawing, in accordance with Fleming's right hand rule. Therefore, when an AC current of low frequency, such as an audio signal current, flows through the conductor 10, conductor 10 will vibrate in accordance with the AC current. As a result, the diaphragm 5 which carries the conductor 10 will be caused to vibrate in accordance with this AC current, and thus the AC current is converted to an acoustic signal. These types of operations are utilized in, for example, headphones and loudspeakers in which such arrangement is provided.

On the other hand, if an acoustic signal is applied to the diaphragm 5, this diaphragm will vibrate in accordance with the acoustic signal applied thereto. This will be accompanied by vibration of the conductor 10 which is carried on the diaphragm 5. As a result, the respective portions of this conductor 10 will naturally traverse the magnetic flux formed by the magnet pieces 8, 8, . . . , and thus and electromotive force is induced in the conductor 10 in accordance with Fleming's right-hand rule. Thus, the acoustic signal is converted to an electric signal by the operation described above.

Figure 6:
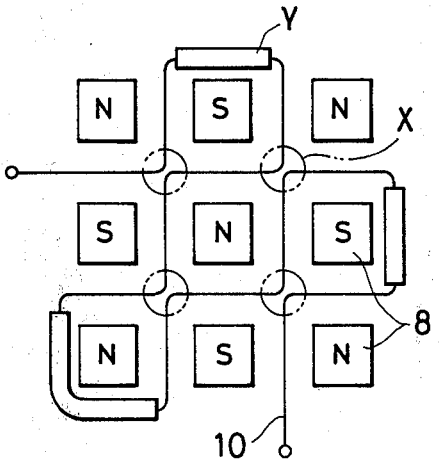
FIG. 6 is an explanatory diagrammatic plan view, showing another embodiment of the present invention.
Figure 7:
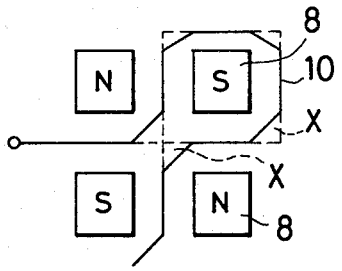
FIG. 7 is an explanatory diagrammatic illustration, showing a modified arrangement of the electric conductor shown in FIG. 6.

FIG. 6 shows another embodiment of the present invention. This embodiment is concerned with an instance wherein the magnet pieces provided on each of the upper and lower magnet plates 6 and 7 are nine (9) in number. FIG. 6 shows the positional relationship between the magnet pieces 8, 8, . . . of the lower magnet plate 7 and the electric conductor 10. It should be noted, however, that those portions of the conductor 10 which are enclosed in circles X of one-dot-chain-lines and those portions indicated at Y which are larger in size than the remainder of the conductor represent the regions where the magnetic fields are weak as will be understood from the nature of magnets, and where, thus, efficiency of the electroacoustic conversion is small. Accordingly, it will become possible to lower the overall impedance or the power loss of the conductor 10 as a whole by reducing the lengths of these portions X and by enlarging the size of the portions Y, thus decreasing the impedance of these portions. FIG. 6, however, shows the instance of arrangement that those portions of the conductor 10 located at the periphery of the magnet pieces are enlarged in size. FIG. 7 shows an instance wherein those portions of the conductor 10 which are marked by X in FIG. 6 are arranged to run in a diagonal pattern, to thereby reduce the overall length of the conductor 10, whereby the abovesaid loss can be reduced.

Description of the present invention has been made above with respect to a basic embodiment shown in FIGS. 3 and 4, wherein there are provided an upper magnet plate 6 and a lower magnet plate 7. It should be noted, however, that the provision of two upper and lower magnet plates 6 and 7 is not mandatory. The present invention may be equally effectively constructed with only a combination of one magnet plate and a diaphragm 5 carrying thereon an electric conductor 10.

It should be understood also that the number of magnet pieces for the magnet plate is not limited to 16 as shown in FIG. 4 or to 9 as in FIG. 6, but that any desired number of magnet pieces can be employed.

Figure 8:
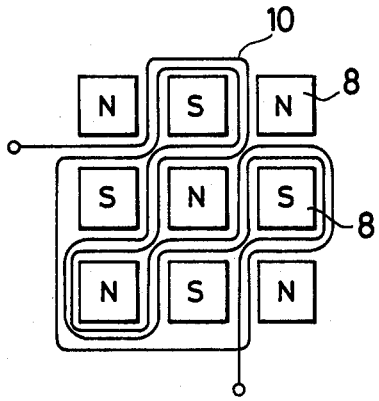
FIG. 8 is an explanatory diagrammatic plan view showing still another embodiment of the present invention.

It should be noted further that the conductor 10 shown in FIG. 4 is provided as a single conductor, but that the conductor 10 may be provided to run in double, or triple, . . . fashion. Such example is shown in FIG. 8. In such case also, it is effective to reduce the impedance of those portions X and Y in a manner as described above.

Figure 9:
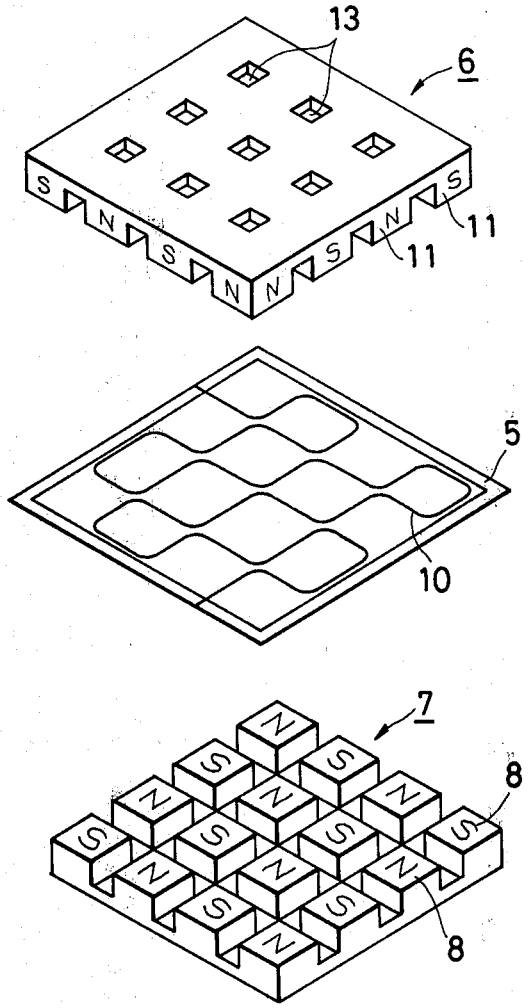
FIG. 9 is an explanatory diagrammatic exploded perspective view of a further embodiment of the present invention.

Description has been made above with respect to an instance of the so-called anistropic structure, i.e. where, as shown in FIG. 4, the upper magnet plate 6 and the lower magnet plate 7 are constructed by securing magnet pieces 11, 11, . . . and 8, 8, . . . to a yoke plates 12 and 9, respectively, so that the N-S poles of these magnet pieces are oriented in a direction perpendicular to the diaphragm 5. It should be understood, however, that an isotropic structure may be employed as shown in FIG. 9. In this embodiment shown in FIG. 9, the magnet pieces of the upper and lower magnet plates 6 and 7 are magnetized so that the magnetic poles are arranged to lie parallel with the diaphragm 5.

As another aid to minimize the development of partial vibrations of the diaphragm, there are provided, in accordance with another aspect of the present invention, ribs on the diaphragm. These ribs are provided at such sites of the diaphragm where nodes of vibration modes of the diaphragm tend to develop easily, so that the conductor is arranged to run at sites other than those regions where the ribs are provided, to thereby practically reduce partial vibrations of the diaphragm and to provide quality sounds. Moreover, in accordance with this aspect of the present invention, the size of those magnet pieces which face each other via the diaphragm is varied, to thereby obtain effective use of the magnetic flux formed by magnet pieces.

Figure 10:
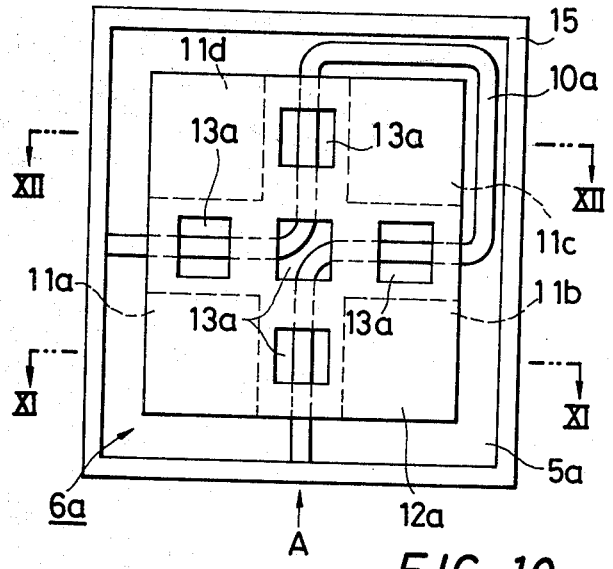
FIG. 10 is an explanatory diagrammatic plan view of a still further embodiment of the present invention.

FIG. 10 shows an explanatory diagrammatic plan view of an embodiment wherein the total number of the magnet pieces is eight (8). In practice, however, the total number of magnet pieces will be greater than just eight (8). It should be understood that a transducer having such a greater number of magnet pieces may be easily materialized as will be seen from the description made hereunder.

Figure 11:
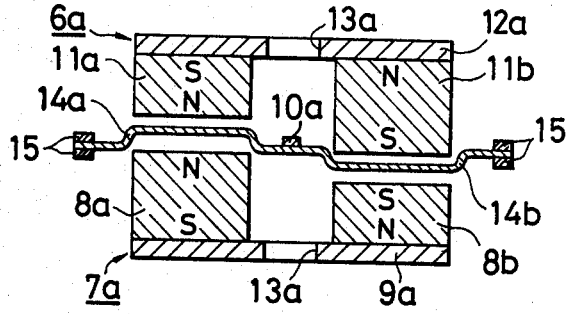
FIG. 11 is a diagrammatic sectional view taken along the line XI—XI in FIG. 10.
Figure 12:
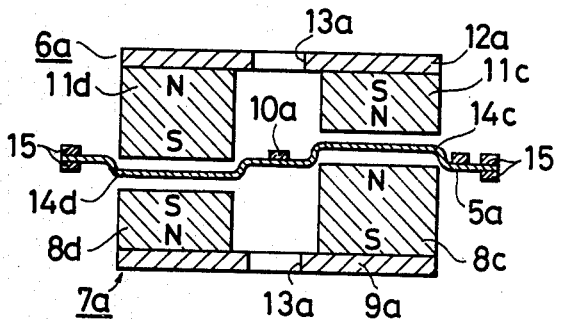
FIG. 12 is a diagrammatic sectional view taken along the line XII—XII in FIG. 10.

In FIG. 10, and FIGS. 11 and 12 which are sections of the structure shown in FIG. 10, the upper magnet plate **6*a* is constructed with a yoke plate 12*a* which, in turn, is made with a ferromagnetic material, and four (4) magnet pieces 11*a*, 11*b*, and 11*c* and 11*d*. These magnet pieces 11*a* through 11*d* are arranged on the yoke plate 12*a* in columns and rows via spaces intervening therebetween. There are provided, in those portions of the yoke plate 12*a* located at positions corresponding to the spaces between the respective magnet pieces, a plurality of sound-passage apertures 13*a*, 13*a*, . . . for discharging to the outside of the plate those acoustic signals produced by the diaphragm 5*a*. The magnet pieces are arranged so that those which are located diagonally relative to each other, i.e. those 11*a* and 11*c*, and those 11*b* and 11*d*, have equal heights, respectively, as noted in FIGS. 11 and 12. Also, those magnet pieces 11*a* and 11*c* have a height smaller than the height of those magnet pieces 11*b* and 11*d*. Also, these magnet pieces 11*a* through 11*d* of the upper yoke plate 12*a* are magnetized in an orientation perpendicular to the yoke plate 12***a*. Also, the magnetic poles of these magnet pieces 11*a* through 11*d* located on that side facing the diaphragm 5*a* are arranged so that the magnet piece 11*a* has an N pole, and the magnet piece 11*b* has an S pole, the magnet piece 11*c* has an N pole and the magnet piece 11*d* has an S pole, so that the magnetic poles are different from each other in the adjacent column and row of the matrix. These magnet pieces 11*a* through 11*d* may be made with those materials described previously with respect to the embodiments shown in FIGS. 3 and 4.

Figure 13:
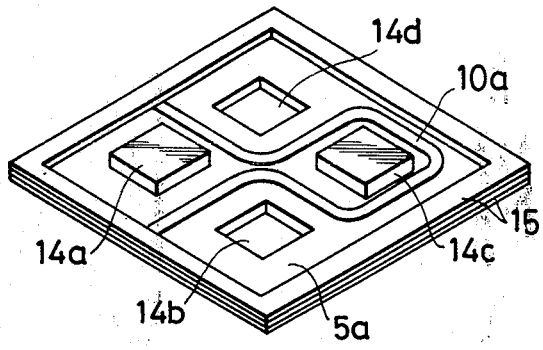
FIG. 13 is an explanatory diagrammatic perspective view of the diaphragm employed in the embodiment of the planar type electroacoustic transducer shown in FIGS. 10 through 12.

The diaphragm 5*a* is provided at such position as facing the magnet pieces 11*a* through 11*d*, and it may be made with a material same as that described in the embodiment shown in FIGS. 3 and 4. This diaphragm 5*a* alone is shown in perspective view in FIG. 13. As will be noted in FIG. 13, this diaphragm 5*a* is provided with a protruding rib 14*a* at a position corresponding to the location of the magnet piece 11*a*, a recessed rib 14*b* at a position corresponding to the location of the magnet piece 11*b*, a protruding rib 14*c* at a position corresponding to the location of the magnet piece 11*c*, and a recessed rib 14*d* at a position corresponding to the location of the magnet piece 11*d*, by an appropriate manufacturing means such as heat-press molding technique. An electric conductor 10*a* which is made with an electroconductive material such as aluminum and copper is provided to run at sites other than the locations of these ribs 14*a* through 14*d*, i.e. at such positions corresponding to the spaces defined between the respective magnet pieces 11*a* through 11*d*. Furthermore, at the marginal portions of the diaphragm 5*a*, there is provided a spacer 15. In a manner as described with respect to the embodiment shown in FIGS. 3 and 4, the electric conductor 10*a* is arranged to run in the pattern of columns and rows within the magnetic fields which are formed by the magnet pieces 11*a* through 11*d*, in such manner that, when an electric current is caused to flow through this conductor 10*a*, the respective portions of this conductor 10*a* are subjected to electromagnetic forces delivered by the magnetic fields and that these electromagnetic forces are oriented in a certain single direction. The diaphragm 5*a* may be formed with U-shaped or V-shaped edges on the inner side of the spacer 15, though not illustrated here. The protruding ribs and recessed ribs 14*a* through 14*d* may be formed after the conductor 10*a* and/or the spacer 15 have been provided on the diaphragm 5*a*.

At positions facing the other side of the diaphragm 5*a*, i.e. on that side of the diaphragm 5*a* opposite to the side facing the upper magnet plate 6*a*, there are provided magnet pieces 8*a*, 8*b*, 8*c* and 8*d* which are secured to a lower yoke plate 9*a*, to jointly constitute a lower magnet plate 7*a*. These magnet pieces 8*a* through 8*d* are positioned to face, via the diaphragm 5*a*, those magnet pieces 11*a* through 11*d* of the upper magnet plate 6*a*, respectively. The direction in which the magnet pieces 8*a* through 8*d* are magnetized is perpendicular to their yoke plate 9*a*. Also, the magnetic poles of these magnet pieces 8*a* through 8*d* on that side facing the diaphragm 5*a* are equal to those magnetic poles at those surfaces of the magnet pieces 11*a* through 11*d*, respectively, of the upper magnet plate 6*a* which are faced by the magnet pieces 8*a* through 8*d* of the lower magnet plate 7*a*. Also, in much the same way as for those magnet pieces of the upper magnet plate 6*a*, the magnet pieces 8*a* and 8*c* have a same height, whereas those magnet pieces 8*b* and 8*d* have another same height. Furthermore, the height of the magnet pieces 8*a* and 8*c* are greater than the height of the magnet pieces 8*b* and 8*d*. That is, as will be understood from FIGS. 11 and 12, the heights of the magnet pieces 11*a* through 11*d* of the upper magnet plate 6*a* and the heights of the magnet pieces 8*a* through 8*d* of the lower magnet plate 7*a* are set in correspondence with the recessed or protruding configurations of these ribs 14*a* through 14*d* which are formed on the diaphragm 5*a*. Thus, the respective magnet pieces which face each other via the intervening diaphragm 5*a* differ in their height relative to each other. By this arrangement, the magnetic gap between the upper magnet plate 6*a* and the lower magnet plate 7*a* is reduced, so that the magnetic fields which are formed by the respective magnet pieces will act effectively on the electric conductor 10*a*. It should be understood that, other than the arrangement per se of the lower magnet plate 7*a* described above, this lower magnet plate 7*a* is same with the upper magnet plate 6*a* with respect to the material and so forth.

Figure 14:
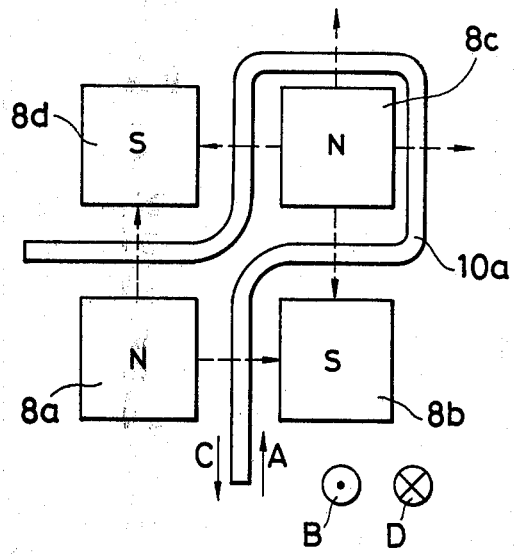
FIG. 14 is an explanatory diagrammatic illustration, showing the positional relationship between the magnet pieces and the electric conductor employed in the embodiment shown in FIGS. 10 through 12.

Description will next be made of the operation of the planar type electroacoustic transducer having the aforesaid arrangement. FIG. 14 shows the positional relationship between the magnet pieces 8*a* through 8*d* of the lower magnet plate 7*a* and the electric conductor 10*a* to explain the operation. It should be noted that the broken lines with arrows in FIG. 14 represent the directions of the magnetic fields which act upon the conductor 10*a*.

Description of operation will first be made of the instance wherein this instant embodiment is applied to headphones or like devices. In FIG. 14, let us assume that an electric current is caused to flow through the conductor 10*a* in the direction indicated by the arrow A. This means that the electric current flows through the conductor 10*a* which lies within the magnetic fields which are formed by the magnet pieces 8*a* through 8*d*. Accordingly, the respective portions of the conductor 10*a* are subjected to electromagnetic forces of a same phase and running in the direction of B shown in FIG. 14, in accordance with Fleming's right-hand rule. Conversely, in case an electric current is caused to flow in the direction of arrow C, the respective portions of the conductor 10*a* will be subjected to electromagnetic forces of a same phase and running in the direction D. Therefore, in case an AC current of low frequency such as an audio signal is caused to flow through the conductor 10*a*, the conductor 10*a* will vibrate in accordance with this AC current of low frequency. As a result, the diaphragm 5*a* on which the conductor 10*a* is secured will vibrate, and the vibration of this diaphragm 5*a* will be derived as an acoustic signal.

Next, description will be made of the operation in case an acoustic signal is applied to the diaphragm 5*a*. This means the operation in the instance that the present invention is applied to a microphone. In case an acoustic signal is applied to the diaphragm 5*a*, the diaphragm will vibrate in accordance with the acoustic signal applied thereto. In accordance therewith, the conductor 10*a* will vibrate. As a result, the respective portions of the conductor 10*a* will traverse the magnetic flux which is formed by the magnet pieces 8*a* through 8*d*. In accordance with Fleming's right-hand rule, there is induced an electromotive force within the conductor 10*a*. In other words, the acoustic signal applied to the diaphragm 5*a* is converted to an electric signal.

Next, description will be made briefly of the process of manufacture of those magnet pieces which are employed in the respective embodiments of the present invention, by referring to FIGS. 15A and 15B, and the FIGS. 16A through 16D.

Figure 15A:
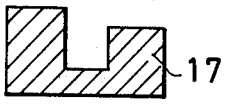
FIGS. 15A and 15B are explanatory diagrammatic illustrations, showing a manner in which the magnet pieces employed in the present invention are made from isotropic magnet powder.
Figure 15B:
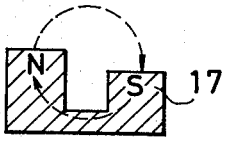

FIGS. 15A and 15B show the steps of making a magnet plate from an isotropic magnet powder such as isotropic barium ferrite. As a first step, the isotropic magnet powder is subjected to compression-molding to provide a compact 17 shown in FIG. 15A. Then, this compact 17 is subjected to sintering at a required temperature, and thereafter the resulting product is magnetized as shown in FIG. 15B.

Figure 16A:
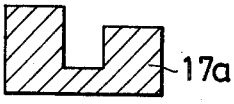
FIGS. 16A through 16D are explanatory diagrammatic illustrations, showing another manner in which the magnet pieces employed in the present invention are made from anisotropic magnet powder.
Figure 16B:
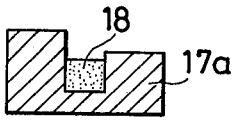
Figure 16C:
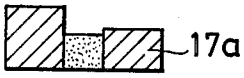
Figure 16D:
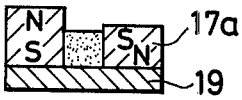

FIGS. 16A through 16D show the steps of making a magnet plate from an anisotropic magnet powder such as anisotropic strontium ferrite. As a first step, the anisotropic magnet powder is subjected to compression-molding into a compact **17*a* as shown in FIG. 16A. After this compact 17*a* is sintered at a predetermined temperature, a molding resin 18 is filled in the recessed portion of the compact 17*a*, as shown in FIG. 16B. Then, the bottom portion of the resulting compact 17*a* is removed by either machining or grinding as shown in FIG. 16C. Finally, a yoke plate 19 is caused to adhere to the bottom surface of the compact 17*a* in a manner as shown in FIG. 16D**. Thereafter, the resulting product is magnetized.

As in the embodiment shown in FIGS. 3 and 4, it should be understood that, in the later embodiments also, the provision of both the upper magnet plate **6*a* and the lower magnet plate 7*a* is not always necessary. Also, the conductor 10*a* may be provided to run in double or triple or any desired number of turns. The pattern of run of the conductor and the size thereof at such portions where the magnetic field is weak may be as described in connection with the embodiment of FIGS. 6 and 7**.

Figure 17:
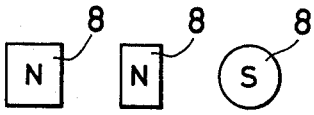
FIG. 17 is a diagrammatic illustration showing some examples of the plan shape of magnet pieces which can be employed in the present invention.

The magnet pieces employed in the present invention may have their plan shapes which are not limited to the square shape shown in FIG. 4 or FIG. 6. They may be made to have round or rectangular shapes as shown in FIG. 17.

In the embodiment shown in FIGS. 10 through 16, the diaphragm is provided with recessed and/or protruding ribs. Therefore, the rigidity of the diaphragm is increased also. Thus, it is possible to expand the range of piston-like movements of the diaphragm as a whole. Also, the conductor is arranged to run, in the modified embodiment, avoiding those regions where there tend to develop nodes of vibration modes of the diaphragm due to the provision of the ribs, and this also contributes to an expansion of the range of piston-like movements of the diaphragm. As a result, it is possible to provide planar type electroacoustic transducers having minimized partial vibrations of the diaphragm and accordingly deliver quality sounds. Furthermore, the different heights of the opposing magnet pieces contributes to an improvement of effective action of magnetic fields upon the conductor.

As referred to above, the present invention can be suitably applied to headphones and like devices. However, it may be effectively applied to microphones and like devices.

What is claimed is:

1. A planar type electroacoustic transducer comprising:

a diaphragm having two surfaces;

at least one set of magnet means facing one of the surfaces of said diaphragm at a distance sufficient to render this surface to lie within magnetic fields generated by said magnet means, said magnet means having, at its surface facing the diaphragm, a plurality of spaced magnetic poles arranged in a matrix shape of columns and rows so that the respective adjacent poles are mutually different; and an electric conductor provided on the diaphragm so as to form a current path continuously extending in alternate directions of a column and a row at sites corresponding to the spaces defined between respective ones of said magnetic poles without continuously passing by any two magnetic poles of a same column or row, while causing magnetic flux generated between adjacent ones of the respective magnetic poles to traverse respective portions of the current path at right angle and in substantially a same direction with respect to a direction of a current flow in the current path, said electric conductor having enlarged portions at such sites of the current path as correspond to outer marginal regions of outermostly located ones of the magnetic poles in the matrix form to provide a small impedance at the portions.

2. A planar type electroacoustic transducer comprising:

a diaphragm having two surfaces;

at least one set of magnet means facing one of the surfaces of said diaphragm at a distance sufficient to render this surface to lie within magnetic fields generated by said magnet means, said magnet means having, at its surface facing the diaphragm, a plurality of spaced magnetic poles arranged in a matrix shape of columns and rows so that the respective adjacent poles are mutually different; and an electric conductor provided on the diaphragm so as to form a current path continuously extending in alternate directions of a column and a row at sites corresponding to the spaces defined between respective ones of said magnetic poles without continuously passing by any two magnetic poles of a same column or row, while causing magnetic flux generated between adjacent ones of the respective magnetic poles to traverse respective portions of the current path at right angles and in substantially a same direction with respect to a direction of a current flow in the current path, said diaphragm being provided with ribs at sites corresponding to the respective magnetic poles, and said electric conductor being formed on a substantially flat part of the surface of the diaphragm containing none of the ribs.

3. A planar type electroacoustic transducer according to claim 1 or 2, in which:

said diaphragm is caused to vibrate to convert an acoustic signal to an electric signal.

4. A planar type electroacoustic transducer according to claim 1 or 2, in which:

said magnet means is comprised of a yoke plate made with a ferromagnetic material and a plurality of bipolar magnets arranged in matrix form on a surface of this yoke plate, and in which:

the magnets are provided so that the directions of either magnetism are perpendicular to the surface of said yoke plate and that the directions of magnetism of any adjacent magnets are opposite to each other.

5. A planar type electroacoustic transducer according to claim 1 or 2, in which:

said magnet means is comprised of an integral magnet having said plurality of magnetic poles and magnetized in a direction parallel with the surface of the diaphragm facing the magnet means.

6. A planar type electroacoustic transducer according to claim 1, in which:

said magnet means is provided in two sets sandwiching the diaphragm therebetween leaving spaces at both sides of the diaphragm, and all of the magnetic poles of the magnet means of one set face the same magnetic poles of the magnet means of the other set via the intervening diaphragm.

7. A planar type electroacoustic transducer according to claim 6, in which:

the magnet means of either one set is provided with at least one acoustic signal passage aperture passing in a direction perpendicular to that surface of the magnet means where magnetic poles are arranged.

8. A planar type electroacoustic transducer according to claim 1 or 2, in which:

said electric conductor extends diagonally relative to a column and a row of the matrix form at corners of the current path running along the column and the row of a magnetic pole.

9. A planar type electroacoustic transducer according to claim 1 or 2, in which:

said electric conductor is supplied with AC current to convert an electric signal to an acoustic signal.

10. A planar type electroacoustic transducer according to claim 2, in which:

the rib located to face one of any adjacent two magnetic poles is of a recessed configuration, and the rib located to face the other of the adjacent two magnetic poles is of a protruding configuration.

11. A planar type electroacoustic transducer according to claim 10, in which:

said magnet means is provided in two sets sandwiching the diaphragm therebetween leaving spaces at both sides of the diaphragm, the magnetic poles of one of the two sets of magnet means face, via the intervening diaphragm, the same magnetic poles of the other of the two sets of magnet means, and those magnetic poles of the respective two sets of magnet means facing the recessed ribs extend farther beyond those magnetic poles facing the protruding rib members.

* * * * *

UNITED STATES PATENT AND TRADEMARK OFFICE

CERTIFICATE OF CORRECTION

PATENT NO. : 4,337,379

DATED : June 29, 1982

INVENTOR(S) : Takao NAKAYA

It is certified that error appears in the above—identified patent and that said Letters Patent is hereby corrected as shown below:

IN THE CLAIMS

Claim 6, column 11, line 8, read "claim 1" as --claim 1 or 2--

Signed and Sealed this

First Day of March 1983

[SEAL]

*Attest:*

GERALD J. MOSSINGHOFF

*Attesting Officer*

*Commissioner of Patents and Trademarks*